US011473234B2

(12) United States Patent
Chae et al.

(10) Patent No.: US 11,473,234 B2
(45) Date of Patent: Oct. 18, 2022

(54) CLOTHES MANAGEMENT APPARATUS

(71) Applicant: Samsung Electronics Co., Ltd., Suwon-si (KR)

(72) Inventors: Gyeong Ryeol Chae, Hwaseong-si (KR); Jung Ha Park, Seongnam-si (KR); Sang Yeon Pyo, Yongin-si (KR); Dong Wook Kim, Suwon-si (KR); Joo Yeon Park, Seoul (KR); Ja Yeon Seo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 171 days.

(21) Appl. No.: 16/764,650

(22) PCT Filed: Sep. 6, 2018

(86) PCT No.: PCT/KR2018/010426
§ 371 (c)(1),
(2) Date: May 15, 2020

(87) PCT Pub. No.: WO2019/135464
PCT Pub. Date: Jul. 11, 2019

(65) Prior Publication Data

US 2020/0370236 A1 Nov. 26, 2020

(30) Foreign Application Priority Data

Jan. 8, 2018 (KR) ..... 10-2018-0002481

(51) Int. Cl.
*D06F 35/00* (2006.01)
*D06F 73/00* (2006.01)
*D06F 73/02* (2006.01)

(52) U.S. Cl.
CPC ..... *D06F 73/02* (2013.01); *D06F 35/00* (2013.01); *D06F 73/00* (2013.01)

(58) Field of Classification Search
None
See application file for complete search history.

(56) References Cited

U.S. PATENT DOCUMENTS

2006/0137206 A1 6/2006 Lee et al.

FOREIGN PATENT DOCUMENTS

| | | |
|---|---|---|
| CN | 1064660301 A | 2/2017 |
| GB | 1 428 107 | 3/1976 |
| JP | 10-298 A | 1/1998 |
| JP | 2001-70696 | 3/2001 |

(Continued)

OTHER PUBLICATIONS

International Search Report dated Jan. 11, 2019 in International Patent Application No. PCT/KR2018/010426.

(Continued)

*Primary Examiner* — Levon J Shahinian
(74) *Attorney, Agent, or Firm* — Staas & Halsey LLP

(57) ABSTRACT

A clothes management apparatus includes a main body including a clothes management compartment, and an upper garment hanger disposed in the clothes management compartment to hang an upper garment. The upper garment hanger includes an inward discharge port to discharge air to the inside of the upper garment and the main body includes an outward discharge port to discharge air to the outside of the upper garment, so that the outside and inside of the upper garment may be managed simultaneously.

14 Claims, 8 Drawing Sheets

(56) References Cited

FOREIGN PATENT DOCUMENTS

| | | |
|---|---|---|
| KR | 10-2006-0008506 | 1/2006 |
| KR | 10-2006-0060211 | 6/2006 |
| KR | 20-0435956 | 3/2007 |
| KR | 10-2011-0035030 | 4/2011 |
| KR | 10-2013-0057340 | 5/2013 |
| KR | 10-2013-0094923 | 8/2013 |
| KR | 10-2013-0101773 | 9/2013 |
| KR | 10-2017-0080559 A | 7/2017 |
| WO | 2011/108860 | 9/2011 |

OTHER PUBLICATIONS

Written Opinion of the International Searching Authority dated Jan. 11, 2019 in International Patent Application No. PCT/KR2018/010426.

Extended European Search Report dated Nov. 26, 2020 in European Patent Application No. 18898677.2.

Korean Office Action dated Mar. 15, 2022 in Korean Application No. 10-2018-0002481.

Office Action dated Jun. 27, 2022 issued in Chinese Application No. 201880085661.5.

CLOTHES MANAGEMENT APPARATUS

CROSS-REFERENCE TO RELATED APPLICATIONS

This application is a U.S. National Stage Application which is based on and claims the priority benefit under 35 U.S.C. § 371 of International Patent Application No. PCT/KR2018/010426, filed on Sep. 6, 2018, which claims the priority benefit of Korean Application No. 10-2018-0002481, filed on Jan. 8, 2018, in the Korean Intellectual Property Office, the disclosures of which are incorporated herein by reference in their entirety.

BACKGROUND

1. Field

The disclosure relates to a clothes management apparatus for removing dust stuck to clothes or odor that has permeated into clothes.

2. Description of Related Art

A clothes management apparatus is an apparatus that performs the management of clothes such as removing dust stuck to clothes or odor that has permeated into clothes, and reducing creases of clothes.

The clothes management apparatus includes a main body provided with a clothes management compartment in which clothes are accommodated and managed, and a door for opening and closing the clothes management compartment. The main body is also provided with an air blower for supplying air or hot air to clothes, and a steam generator for supplying steam to clothes.

Therefore, the clothes management apparatus performs a function of supplying air or hot air generated by the air blower to clothes to remove dust stuck to clothes or odor that has permeated into clothes and a function of spraying steam generated by the steam generator to smooth out creases formed in clothes.

SUMMARY

Additional aspects and/or advantages will be set forth in part in the description which follows and, in part, will be apparent from the description, or may be learned by practice of the presented embodiments.

It is an aspect of the disclosure to provide a clothes management apparatus capable of simultaneously blowing air to the inside and outside of an upper garment.

It is an aspect of the disclosure to provide a clothes management apparatus capable of blowing air on both arms of an upper garment as well as on a body of the upper garment.

In accordance with an aspect of the disclosure, a clothes management apparatus includes a main body including a clothes management compartment, and an upper garment hanger disposed in the clothes management compartment to hang an upper garment, wherein the upper garment hanger includes a connection hole connected to the main body to receive air, and an inward discharge port to discharge air to the inside of the upper garment, and the main body includes an outward discharge port to discharge air to the outside of the upper garment.

The upper garment hanger further includes a first flow passage to guide air to the inside of a body of the upper garment, and a pair of second flow passages provided to be inclined downward on opposite sides of the first flow passage to guide air to the inside of both arms of the upper garment.

The main body includes a plurality of discharge pipes formed in a rectangular shape elongated in the front-rear direction and disposed to be spaced apart in parallel from each other, and a plurality of the outward discharge ports each provided between the plurality of discharge pipes and at both sides of the plurality of discharge pipes.

The upper garment hanger is detachably installed in the main body.

The main body includes at least one discharge pipe connected to the upper garment hanger, and the upper garment hanger is movably installed on the discharge pipe to be installed or separated to or from the discharge pipe by the movement.

The upper garment hanger includes a first guide rail provided at an upper end thereof in the front-rear direction, and the discharge pipe includes a second guide rail provided at a lower end thereof in the front-rear direction to be movably installed in the first guide rail.

The clothes management apparatus further includes a lower garment hanger connected to a lower side of the upper garment hanger, wherein the lower garment hanger includes a lower garment hanging portion extending horizontally to hang a lower garment.

The lower garment hanging portion includes four wires arranged in parallel vertically and horizontally.

The lower garment hanger further includes a filter accommodation portion connected to the lower garment hanging portion to accommodate a filter.

In accordance with an aspect of the disclosure, a clothes management apparatus includes a main body including a clothes management compartment, and an upper garment hanger disposed in the clothes management compartment to hang an upper garment, wherein the upper garment hanger includes a connection hole connected to the main body to receive air, an inward discharge port to discharge air to the inside of the upper garment, a first flow passage to guide air to the inside of a body of the upper garment, and a pair of second flow passages provided to be inclined downward on opposite sides of the first flow passage to guide air to the inside of both arms of the upper garment.

In accordance with an aspect of the disclosure, a clothes management apparatus includes a main body including a clothes management compartment, and a clothes hanger detachably installed in the clothes management compartment, wherein the clothes hanger includes an upper garment hanger to hang an upper garment, and a lower garment hanger connected to a lower side of the upper garment hanger to hang a lower garment.

The clothes management apparatus according to the disclosure can simultaneously discharge air and steam to the inside and outside of an upper garment, so that not only the outside but also the inside of the upper garment can be managed simultaneously.

In addition, the clothes management apparatus according to the disclosure can supply air to both arms of an upper garment as well as a body of the upper garment, so that both of the arms of the upper garment can be managed more efficiently.

BRIEF DESCRIPTION OF THE DRAWINGS

The above and other aspects, features, and advantages of particular embodiments of the disclosure will be more apparent from the following description taken in conjunction with the accompanying drawings, in which.

DETAILED DESCRIPTION

Figure 1:
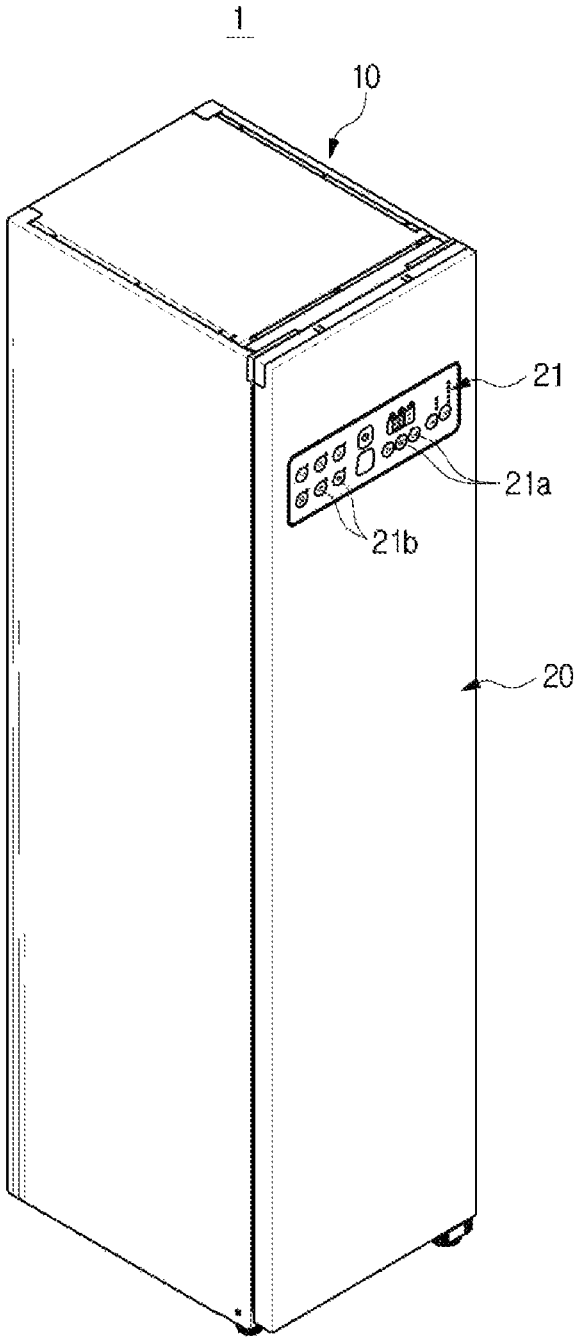
FIG. 1 is a perspective view of a clothes management apparatus according to an embodiment of the disclosure.

The embodiments described herein and the configurations shown in the drawings are only examples of preferred embodiments of the disclosure, and various modifications may be made at the time of filing of the disclosure to replace the embodiments and drawings of the specification.

Like reference numbers or signs in the various figures of the application represent parts or components that perform substantially the same functions.

The terms used herein are for the purpose of describing the embodiments and are not intended to restrict and/or to limit the disclosure. For example, the singular expressions herein may include plural expressions, unless the context clearly dictates otherwise. The terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another. For example, without departing from the scope of the disclosure, the first component may be referred to as a second component, and similarly, the second component may also be referred to as a first component. The term "and/or" includes any combination of a plurality of related items or any one of a plurality of related items.

In this specification, the terms "front," "rear," "upper," "lower," "left," and "right" are defined with reference to the drawings, and the shape and position of each component are not limited by these terms.

Hereinafter, a clothes management apparatus according to an embodiment of the disclosure will be described in detail with reference to the drawings.

Figure 2:
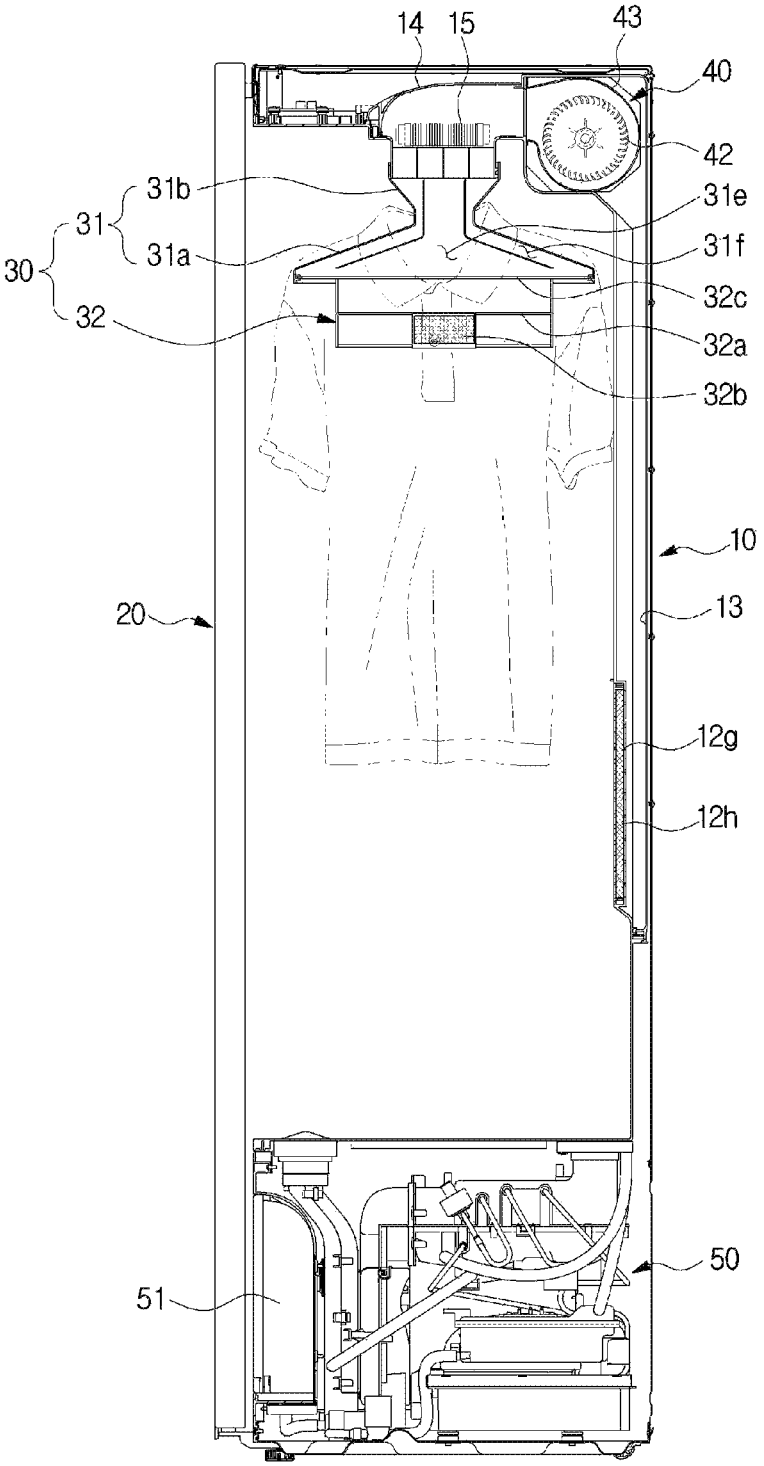
FIG. 2 is a side cross-sectional view of a clothes management apparatus according to an embodiment of the disclosure.

FIG. 1 is a perspective view of a clothes management apparatus according to an embodiment of the disclosure, and FIG. 2 is a side cross-sectional view of a clothes management apparatus according to an embodiment of the disclosure.

As illustrated in FIGS. 1 and 2, a clothes management apparatus 1 includes a main body 10 including a clothes management compartment 10*a* in which clothes are accommodated and managed, a door 20 to open and close the clothes management compartment 10*a*, and a clothes hanger 30 disposed in the clothes management compartment 10*a* to hang clothes.

The clothes management apparatus 1 further includes an air blower 40 disposed at an upper portion of the main body 10 to supply air to the clothes management compartment 10*a*, and a steam generator 50 disposed at a lower portion of the main body 10 to generate steam to be supplied to the clothes management compartment 10*a*. Although not explicitly shown in the drawings, the clothes management apparatus 1 may include components that constitute a refrigeration cycle for dehumidification of clothes.

Accordingly, in a state where clothes are disposed in the clothes management compartment 10*a*, the air generated by the air blower 40 is supplied to the clothes management compartment 10*a* so that dust stuck to clothes and odor that has permeated into clothes may be removed, and the steam generated by the steam generator 50 is supplied to the clothes management compartment 10*a* so that creases of clothes may be removed.

Figure 3:
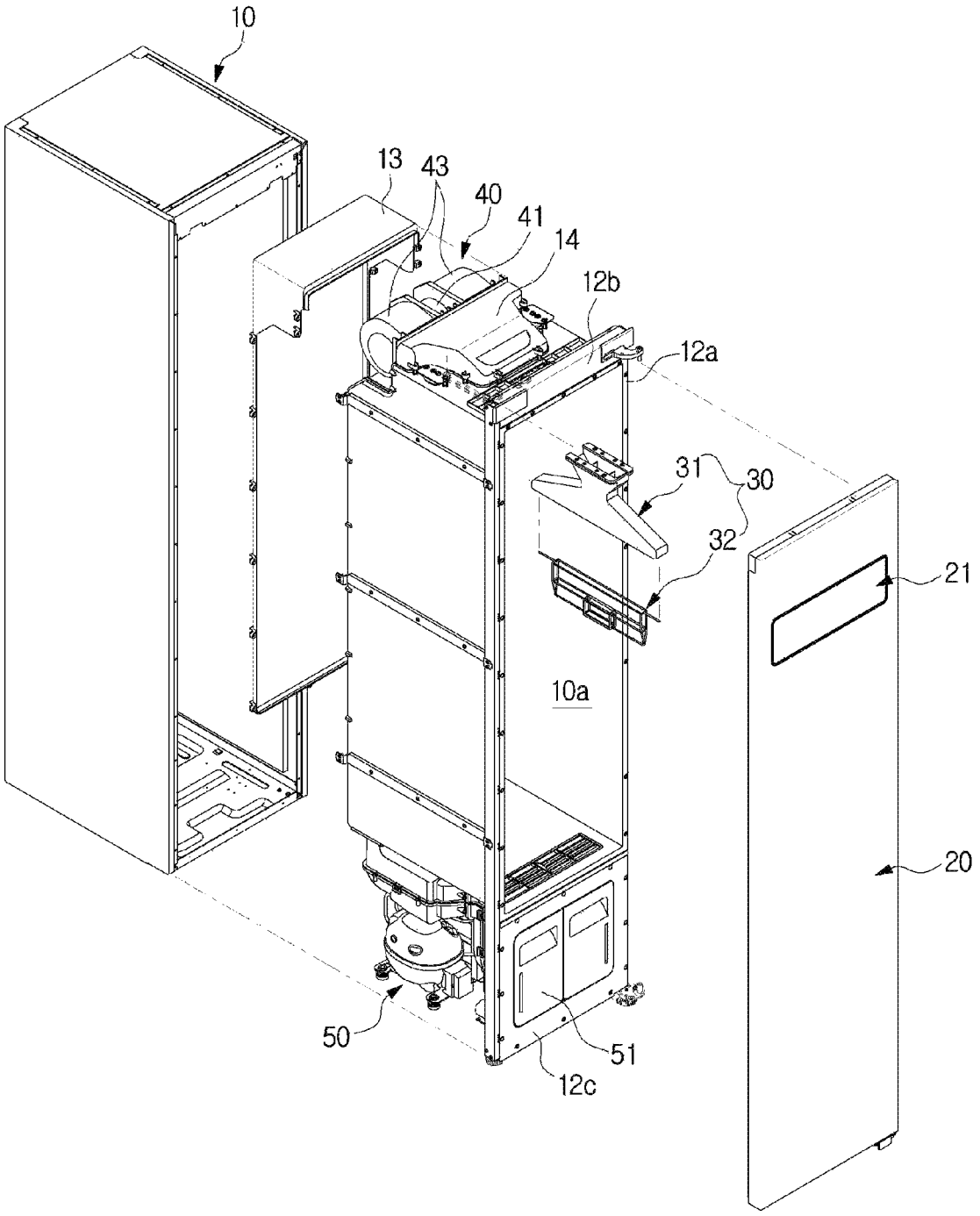
FIG. 3 is an exploded perspective view of a clothes management apparatus according to an embodiment of the disclosure.

FIG. 3 is an exploded perspective view of a clothes management apparatus according to an embodiment of the disclosure.

The main body 10 includes an outer housing 11, an inner housing 12 disposed inside the outer housing 11 to partition the inside space of the outer housing 11, and ducts 13 and 14 disposed between the outer housing 11 and the inner housing 12 to guide the circulation of air.

The door 20 is rotatably installed on one side of a front surface of the main body 10 to open and close the clothes management compartment 10*a*.

The door 20 includes a control panel 21 provided on a front surface thereof for allowing a user to select the operation of the clothes management apparatus 1. The control panel 21 includes various buttons 21*a* for allowing the user to select the operation of the clothes management apparatus 1, and a display 21*b* on which an operation state and the like of the clothes management apparatus 1 is displayed.

The outer housing 11 is formed in a vertically long box shape to form an outer appearance of the main body 10. A front surface of the outer housing 11 is opened and the inner housing 12, the air blower 40 and the steam generator 50 are accommodated inside the outer housing 11.

The inner housing 12, which is formed in a box shape with its front surface opened, includes a clothes management portion 12*a* to form the clothes management compartment 10*a*, an upper cover portion 12*b* extending upward from an upper end of the clothes management portion 12*a* to form a space in which the air blower 40 is accommodated, and a lower cover portion 12*c* extending downward from a lower end of the clothes management portion 12*a* to form a space in which the steam generator 50 is accommodated.

A discharge pipe, or interior air discharge pipe, 12*d* to discharge air to the inside of the clothes hanger 30 is disposed on an inner upper surface of the clothes management portion 12*a* of the inner housing 12, and outward, or exterior, discharge ports 12*e* to discharge air to both sides of an upper garment hung on the clothes hanger 30 are provided at both sides of the discharge pipe 12*d*.

Figure 4:
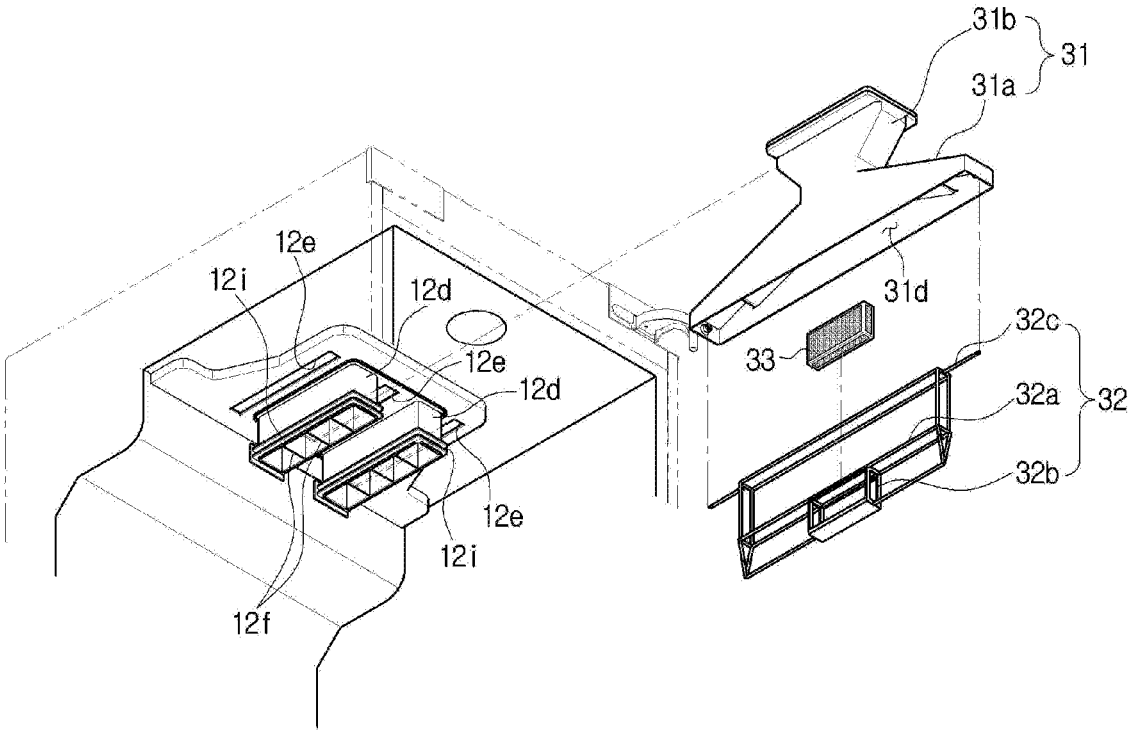
FIG. 4 is an exploded perspective view of a clothes hanger applied to a clothes management apparatus according to an embodiment of the disclosure.
Figure 5:
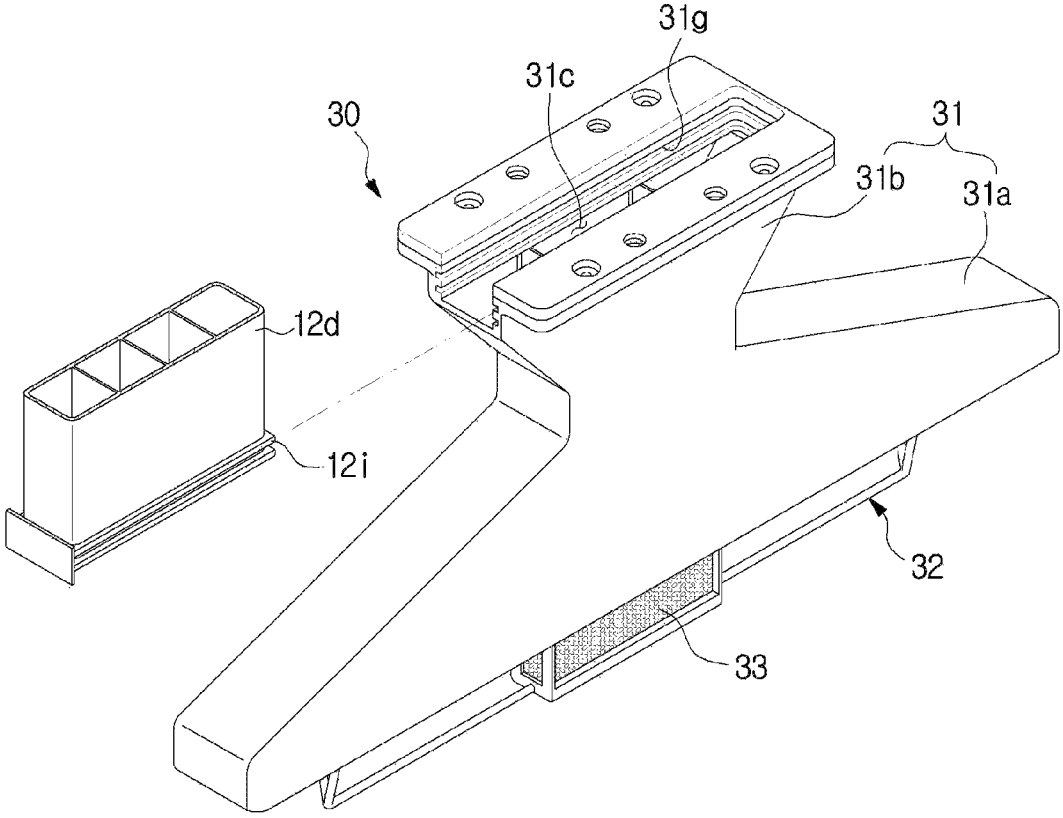
FIG. 5 is a perspective view of a clothes hanger applied to a clothes management apparatus according to an embodiment of the disclosure.
Figure 6:
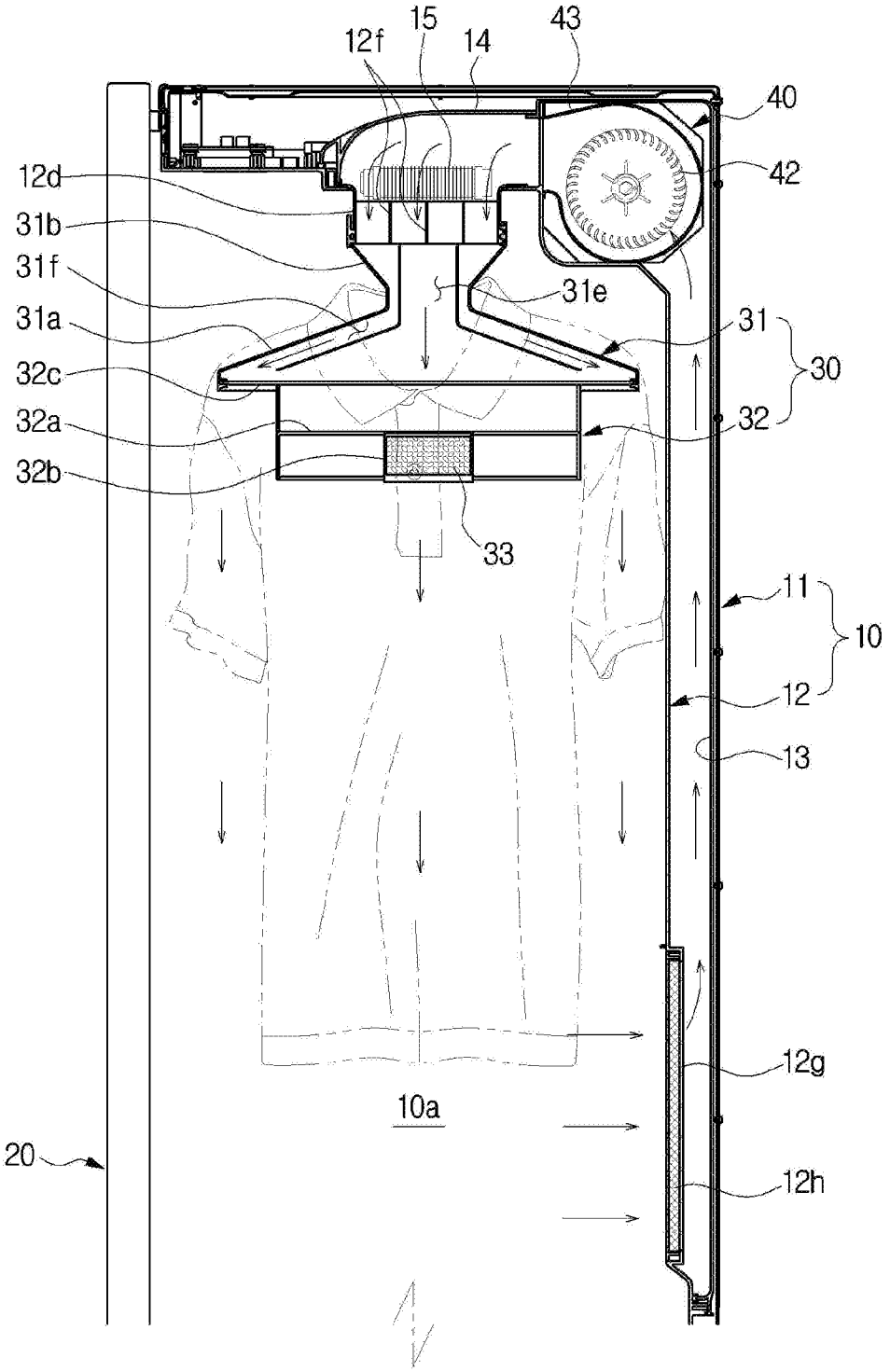
FIG. 6 is a side cross-sectional side view illustrating a state in which a clothes management apparatus according to an embodiment of the disclosure operates.

As illustrated in FIGS. 4 and 5, the discharge pipe 12*d* is formed by a pipe having a rectangular shape elongated in the front-rear direction. In this embodiment, two of the discharge pipes 12*d* are arranged to be spaced apart from each other and to be in parallel in the left-right direction so as to hang two pieces of clothes. The inside of the discharge pipes 12*d* are divided through a plurality of partitions 12*f* which are spaced apart from each other in the front-rear direction, so that air is evenly dispersed and discharged back and forth by the partitions 12*f*.

The outward discharge ports 12*e* are each provided between two of the discharge pipes 12*d* and at both sides of the discharge pipes 12*d*. That is, a total of three of the outward discharge ports 12*e* are provided.

Figure 7:
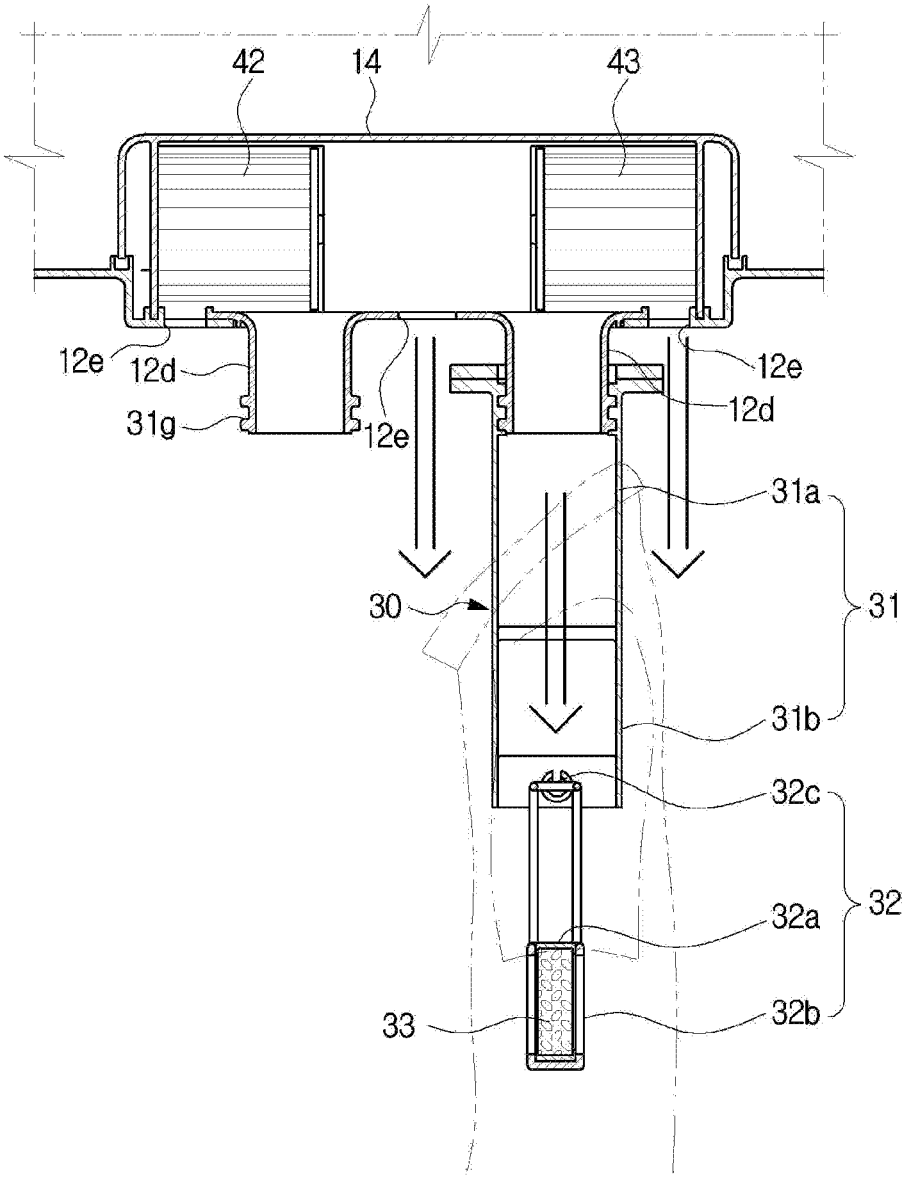
FIG. 7 is a front cross-sectional view illustrating a state in which air is discharged through a clothes hanger in a clothes management apparatus according to an embodiment of the disclosure.

Accordingly, as illustrated in FIG. 7, the air discharged from the discharge pipes 12*d* is transferred to the inside of an upper garment through the clothes hanger 30 to separate dust stuck to the inner surface of the upper garment or to remove odor that has permeated into the inner surface of the upper garment. In addition, the air discharged through the outward discharge ports 12*e* comes in contact with the outer surface of the upper garments hung on two of the adjacent clothes hangers 30 to separate dust stuck to the outer surface of the upper garments or remove odor that has permeated into the outer surface of the upper garments.

The embodiment illustrates that the clothes management apparatus 1 includes two of the discharge pipes 12*d* and three of the outward discharge ports 12*e* in the clothes management compartment 10*a*, but this is only an example. For example, the clothes management apparatus 1 may include one of the discharge pipe 12*d* and two of the outward discharge ports 12*e*, or may include three or more of the discharge pipes 12*d* and four or more of the outward discharge ports 12*e*.

Referring to FIGS. 2 and 3, the ducts 13 and 14 include the suction duct 13 for guiding the air inside the clothes management compartment 10*a* to the air blower 40, and the discharge duct 14 for dispersing and guiding the air discharged from the air blower 40 to the discharge pipes 12*d* and the outward discharge ports 12*e*. In addition, a heater 15 generating hot air by heating the air before being discharged to the discharge pipes 12*d* is disposed inside the discharge duct 14.

The suction duct 13 is provided such that a lower portion of the suction duct 13 is connected to a lower end portion of a rear surface of the clothes management portion 12*a* and an upper end portion of the suction duct 13 covers the air blower 40. The discharge duct 14 is provided such that a rear end portion of the discharge duct 14 is connected to the air blower 40 and a front end portion of the discharge duct 14 covers an outer upper surface of the clothes management portion 12*a*, and thus the discharge duct 14 is connected to the discharge pipes 12*d* and the outward discharge ports 12*e*.

A suction port 12*g* for allowing the air in the clothes management compartment 10*a* to be introduced into the suction duct 13 is provided on the rear surface of the clothes management portion 12*a* and a filter 12*h* for collecting foreign substances such as dust is disposed in the suction port 12*g*.

The air blower 40 is installed at a rear side above the clothes management portion 12*a*, and includes a driving motor 41 for a rotational force, two blowing fans 42 rotated by the driving motor 41, and a pair of fan cases 43 for accommodating two of the blowing fans 42, respectively.

The driving motor 41 has a shaft protruding from opposite sides of the driving motor 41, and two of the blowing fans 42 are installed on the opposite ends of the shaft, so that two of the blowing fans 42 are simultaneously rotated by the driving motor 41.

Two of the blowing fans 42 are provided as a centrifugal fan for sucking air in an axial direction and discharging air outward in a radial direction.

The fan cases 43 are provided with a suction port (not shown) at opposite sides thereof and a discharge port (not shown) at a front side thereof to guide the air sucked from the opposite sides to the front side.

The steam generator 50 includes a water tank 51 for storing water, a heater (not shown) for heating water to generate steam, and the like. The water tank 51 is detachably installed through the lower cover portion 12*c* described above. The steam generated in the steam generator 50 is transferred to the air blower 40 and supplied to the clothes management compartment 10*a* through the air blower 40.

As illustrated in FIGS. 4 and 5, the clothes hanger 30 includes an upper garment hanger 31 for hanging an upper garment such as a coat and a jacket, and a lower garment hanger 32 connected to a lower side of the upper garment hanger 31 to hang a lower garment such as trousers and pants.

The upper garment hanger 31 includes an upper garment hanging portion 31*a* formed in a substantially triangular shape with its width increasing toward a lower side to hang an upper garment, and a connection pipe portion 31*b* extending upward from an upper end of the upper garment hanging portion 31*a* and connected to the discharge pipes 12*d*.

Figure 8:
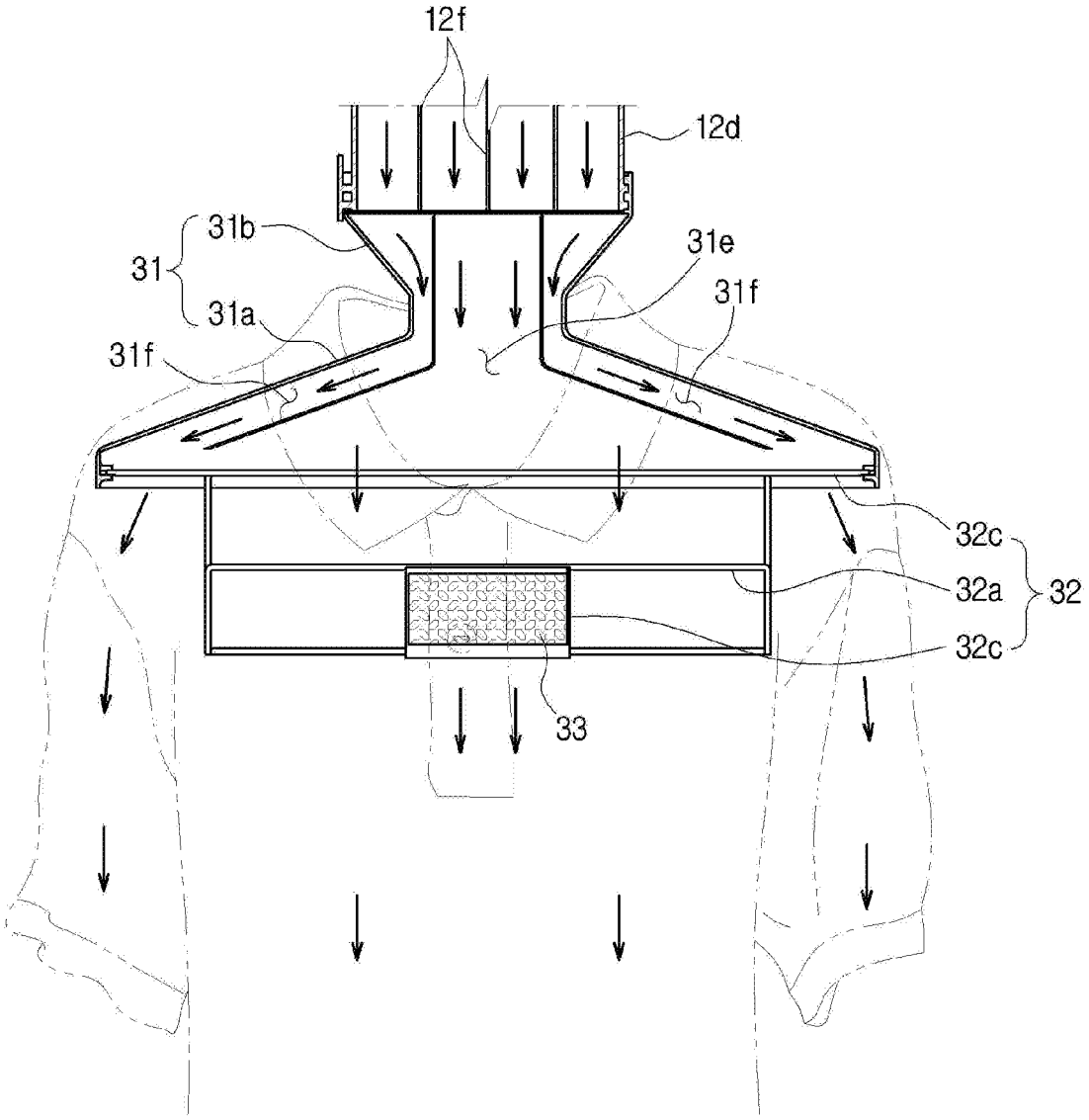
FIG. 8 is a side cross-sectional view illustrating a state in which air is discharged through a clothes hanger in a clothes management apparatus according to an embodiment of the disclosure.

An upper end of the connection pipe portion 31*b* is connected to the discharge pipes 12*d* to form a connection hole 31*c* for receiving air from the discharge pipes 12*d*, and a lower surface of the upper garment hanging portion 31*a* forms an inward discharge port 31*d* to discharge air to the inside of the upper garment hung on the upper garment hanging portion 31*a*. As illustrated in FIG. 8, the upper garment hanger 31 is provided with flow passages 31*e* and 31*f* therein to guide the air, which is transferred through the connection hole 31*c*, to the inward discharge port 31*d*.

The flow passages 31*e* and 31*f* include the first flow passage 31*e* to guide air to the inside of a body of the upper garment hung on the upper garment hanger 31, and a pair of the second flow passages 31*f* formed to be inclined downward from opposite sides of the first flow passage 31*e* so as to guide air to the inside of both arms, or sleeves, of the upper garment hung on the upper garment hanger 31.

Accordingly, since air is dispersed not only to the inside of a body of an upper garment but also to the inside of both arms of the upper garment through the first flow passage 31*e* and the second flow passages 31*f*, dust, odor and creases on both of the arms of the upper garment as well as on the body of the upper garment may be removed.

The lower garment hanger 32 includes a lower garment hanging portion 32*a* extending in a horizontal direction to hang a lower garment, a filter accommodation portion 32*b* provided at a lower side of the lower garment hanging portion 32*a* to accommodate various kinds of filters 33 that may perform various functions, and a connection portion 32*c* provided at an upper side of the lower garment hanging portion 32*a* to connect the lower garment hanger 32 to the upper garment hanger 31. As described above, since the lower garment hanger 32 is connected to a lower side of the upper garment hanger 31, the lower garment hung on the lower garment hanging portion 32*a* is located inside the upper garment hung on the upper garment hanging portion 31*a*.

Accordingly, the air discharged through the second flow passage 31*f* to the inside of the upper garment passes through the lower garment hung on the lower garment hanging portion 32*a* in the process of passing through the inside of the body of the upper garment, and thus dust stuck to the lower garment, odor permeated into the lower garment, and creases of the lower garment also are removed.

The lower garment hanging portion 32*a* includes two wires extending horizontally and spaced left and right in parallel with each other. Accordingly, the space between two of the wires in a state where the lower garment is hung on the lower garment hanging portion 32*a* serves as a flow passage through which air may pass.

The filter accommodation portion 32*b* is connected to a lower side of the lower garment hanging portion 32*a* and formed by wires similarly to the lower garment hanging portion 32*a*. In the filter accommodation portion 32*b*, various kinds of the filters 33 such as deodorant, fragrance and the like may be selectively arranged by the user.

In this embodiment, the clothes hanger 30 is detachably installed on the main body 10 so that clothes may be hung in a state while the clothes hanger 30 is separated from the main body 10.

To this end, as illustrated in FIG. 5, the clothes hanger 30 includes a first guide rail 31*g* provided at the upper end of the connection pipe portion 31*b*, and the main body 10 includes a second guide rail 12*i* provided at a lower end of the discharge pipe 12*d* to move along the first guide rail 31*g*. The first guide rail 31*g* is provided on inner opposite sides and a front side of the upper end of the connection pipe portion 31*b*, and the second guide rail 12*i* is provided on opposite sides and a rear side of the lower end of the discharge pipe 12*d* so as to correspond to the first guide rail 31*g*.

Therefore, because the clothes hanger 30 is separated from the discharge pipe 12*d* when the clothes hanger 30 is moved to the front side, the user may hang clothes on the clothes hanger 30 in a state where the clothes hanger 30 is separated from the main body 10.

When the clothes hanger 30 with clothes is moved to the rear side so that the first guide rail 31*g* is coupled to the second guide rail 12*i*, the connection pipe portion 31*b* of the clothes hanger 30 is again connected to the discharge pipe 12*d*, and thus air may be transferred to the clothes hanger 30 through the discharge pipe 12*d*. Therefore, the user may easily hang clothes on the clothes hanger 30.

In this embodiment, the clothes hanger 30 is detachably installed in the clothes management compartment 10*a* through the first guide rail 31*g* and the second guide rail 12*i*, but the disclosure is not limited thereto, and the clothes hanger 30 may be detachably installed in the clothes management compartment 10*a* through a magnet or the like. The clothes hanger 30 may also be fixedly installed in the clothes management compartment 10*a*.

It will be apparent to those skilled in the art that various modifications and variations may be made in the disclosure without departing from the spirit and scope of the disclosure. Therefore, it is to be understood that the disclosure covers modifications and variations of this disclosure provided they come within the scope of the appended claims and their equivalents.

The invention claimed is:

1. A clothes management apparatus comprising:

a main body including a clothes management compartment and at least one interior air discharge pipe configured to discharge air from the main body; and an upper garment hanger attachable to the main body in the clothes management compartment and configured to support an upper garment hung on the upper garment hanger while the upper garment hanger is attached to the main body, wherein:

the upper garment hanger includes a connection hole connectable to the at least one interior air discharge pipe of the main body to receive air from the at least one interior air discharge pipe of the main body into an interior of the upper garment hanger through the connection hole, and at least one upper garment hanger air discharge port to discharge air from the interior of the upper garment hanger to an inside of the upper garment while the upper garment hanger is attached to the main body and the upper garment is hung on the upper garment hanger;

the main body further includes at least one exterior air discharge port configured to discharge air from the main body to an outside of the upper garment while the upper garment hanger is attached to the main body and the upper garment is hung on the upper garment hanger, the at least one interior air discharge pipe includes a plurality of interior air discharge pipes disposed to be spaced apart in parallel from each other; and the at least one exterior air discharge port includes a plurality of exterior air discharge ports respectively alternately provided between the plurality of interior air discharge pipes.

2. The clothes management apparatus according to claim 1, wherein:

the at least one upper garment hanger air discharge port includes a body air discharge port and a pair of sleeve air discharge ports, and the upper garment hanger further includes a first flow passage to guide air from the connection hole to an inside of a body of the upper garment through the body air discharge port, and a pair of second flow passages provided to be inclined downward on opposite sides of the first flow passage to guide air from the connection hole to an inside of respective sleeves of the upper garment through the respective pair of sleeve air discharge ports.

3. The clothes management apparatus according to claim 1, wherein the at least one interior air discharge pipe is formed in a rectangular shape.

4. The clothes management apparatus according to claim 1, wherein:

the upper garment hanger is detachably installed on the main body in the clothes management compartment.

5. The clothes management apparatus according to claim 1, wherein:

the upper garment hanger is movably installed on the at least one interior air discharge pipe to be installed on or separated from the at least one interior air discharge pipe by movement.

6. The clothes management apparatus according to claim 5, wherein:

the upper garment hanger includes a first guide rail provided at an upper end of the upper garment hanger, and the at least one interior air discharge pipe includes a second guide rail provided at a lower end of the at least one interior air discharge pipe to be movably installed in the first guide rail.

7. The clothes management apparatus according to claim 1, further comprising:

a lower garment hanger connected to a lower side of the upper garment hanger, wherein the lower garment hanger includes a lower garment hanging portion extending horizontally and configured to support a lower garment hung on the lower garment hanger.

8. The clothes management apparatus according to claim 7, wherein:

the lower garment hanging portion includes four wires.

9. The clothes management apparatus according to claim 7, wherein:

the lower garment hanger further includes a filter accommodation portion connected to the lower garment hanging portion to accommodate a filter.

10. A clothes management apparatus comprising:

a main body including a clothes management compartment and an interior air discharge pipe configured to discharge air from the main body; and an upper garment hanger attachable to the main body in the clothes management compartment and configured to support an upper garment hung on the upper garment hanger while the upper garment hanger is attached to the main body, wherein the upper garment hanger includes a connection hole connectable to the interior air discharge pipe of the main body to receive air from the interior air discharge pipe of the main body into an interior of the upper garment hanger through the connection hole, an upper garment hanger air discharge port to discharge air from the interior of the upper garment hanger to an inside of the upper garment while the upper garment hanger is attached to the main body and the upper garment is hung on the upper garment hanger, a first flow passage to guide air from the connection hole to an inside of a body of the upper garment through the body air discharge port, and a pair of second flow passages provided to be inclined downward on opposite sides of the first flow passage to guide air from the connection hole to an inside of respective sleeves of the upper garment through the respective pair of sleeve air discharge ports.

11. The clothes management apparatus according to claim 10, wherein:

the main body further includes an exterior air discharge port configured to discharge air from the main body to an outside of the upper garment while the upper garment hanger is attached to the main body and the upper garment is hung on the upper garment hanger.

12. A clothes management apparatus comprising:

a main body including a clothes management compartment and an air discharge pipe; and a clothes hanger detachably installed on the main body in the clothes management compartment;

a steam generator configured to provide steam to the main body; and an air blower disposed on an upper portion of the main body and to which the steam is transferred, wherein the clothes hanger includes an upper garment hanger configured to support an upper garment hung on the upper garment hanger while the clothes hanger is attached to the main body, and a lower garment hanger connected to a lower side of the upper garment hanger and configured to support a lower garment hung on the lower garment hanger while the clothes hanger is attached to the main body, and the air discharge pipe is configured to discharge air supplied by the air blower and the steam generated in the steam generator into the clothes hanger.

13. The clothes management apparatus according to claim 12, wherein:

the clothes hanger is detachably installed on the air discharge pipe.

14. The clothes management apparatus according to claim 13, wherein:

the clothes hanger includes a first guide rail provided at an upper end of the clothes hanger, and the air discharge pipe includes a second guide rail provided at a lower end of the air discharge pipe to be movably installed in the first guide rail.

* * * * *